US011466493B2

(12) United States Patent
Capur et al.

(10) Patent No.: US 11,466,493 B2
(45) Date of Patent: Oct. 11, 2022

(54) HINGE FOR AN ITEM OF FURNITURE

(71) Applicant: Samet Kalip Ve Maden Esya San. Ve Tic. A.S., Istanbul (TR)

(72) Inventors: Ertac Capur, Istanbul (TR); Ufuk Kiziltan, Istanbul (TR); Himmet Tanriverdi, Istanbul (TR)

(73) Assignee: Samet Kalip Ve Maden Esya San. Ve Tic. A.S.

( * ) Notice: Subject to any disclaimer, the term of this patent is extended or adjusted under 35 U.S.C. 154(b) by 0 days.

(21) Appl. No.: 17/254,457

(22) PCT Filed: Jun. 26, 2018

(86) PCT No.: PCT/TR2018/050325

§ 371 (c)(1),
(2) Date: Dec. 21, 2020

(87) PCT Pub. No.: WO2020/005174

PCT Pub. Date: Jan. 2, 2020

(65) Prior Publication Data

US 2021/0148147 A1 May 20, 2021

(51) Int. Cl.
*E05D 15/50* (2006.01)
*E05D 7/04* (2006.01)
(Continued)

(52) U.S. Cl.
CPC ..... *E05D 7/0423* (2013.01); *E05D 5/065* (2013.01); *E05D 7/1083* (2013.01); *E05F 5/006* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 3,977,043 A 8/1976 Zernig
5,105,506 A * 4/1992 Lin ..... E05D 7/125 16/DIG. 43
(Continued)

FOREIGN PATENT DOCUMENTS

AT 351404 B 7/1979
CN 103348081 A 10/2013
(Continued)

OTHER PUBLICATIONS

China Office Action for corresponding patent application No. 201880093730.7. dated Oct. 10, 2021, 7 pages (not prior art).
(Continued)

*Primary Examiner* — Chuck Y Mah
(74) *Attorney, Agent, or Firm* — Lucian Wayne Beavers; Patterson Intellectual Property Law, PC

(57) ABSTRACT

The invention relates to a hinge for an item of furniture, comprising a first and a second hinge part (100, 200) that are pivotably interconnected by means of a hinged connection, the second hinge part (200) carrying or comprising a mounting element (300), the mounting element (300) comprising at least one guide assembly comprising at least one guide (405) that extends in the direction of a longitudinal axis (L) of the mounting element (300),
the mounting element (300) being connected to a retaining part (400) when in the mounting position, and the guide assembly acting between the mounting element (300) and the retaining part (400), by means of which guide assembly the mounting element (300) can be moved into a mounting position in a manner guided in the guide direction. A significant improvement in the ease of mounting is achieved in a hinge of this kind if the guide assembly comprises a first centering guide (406), by means of which the mounting
(Continued)

Figure 1:
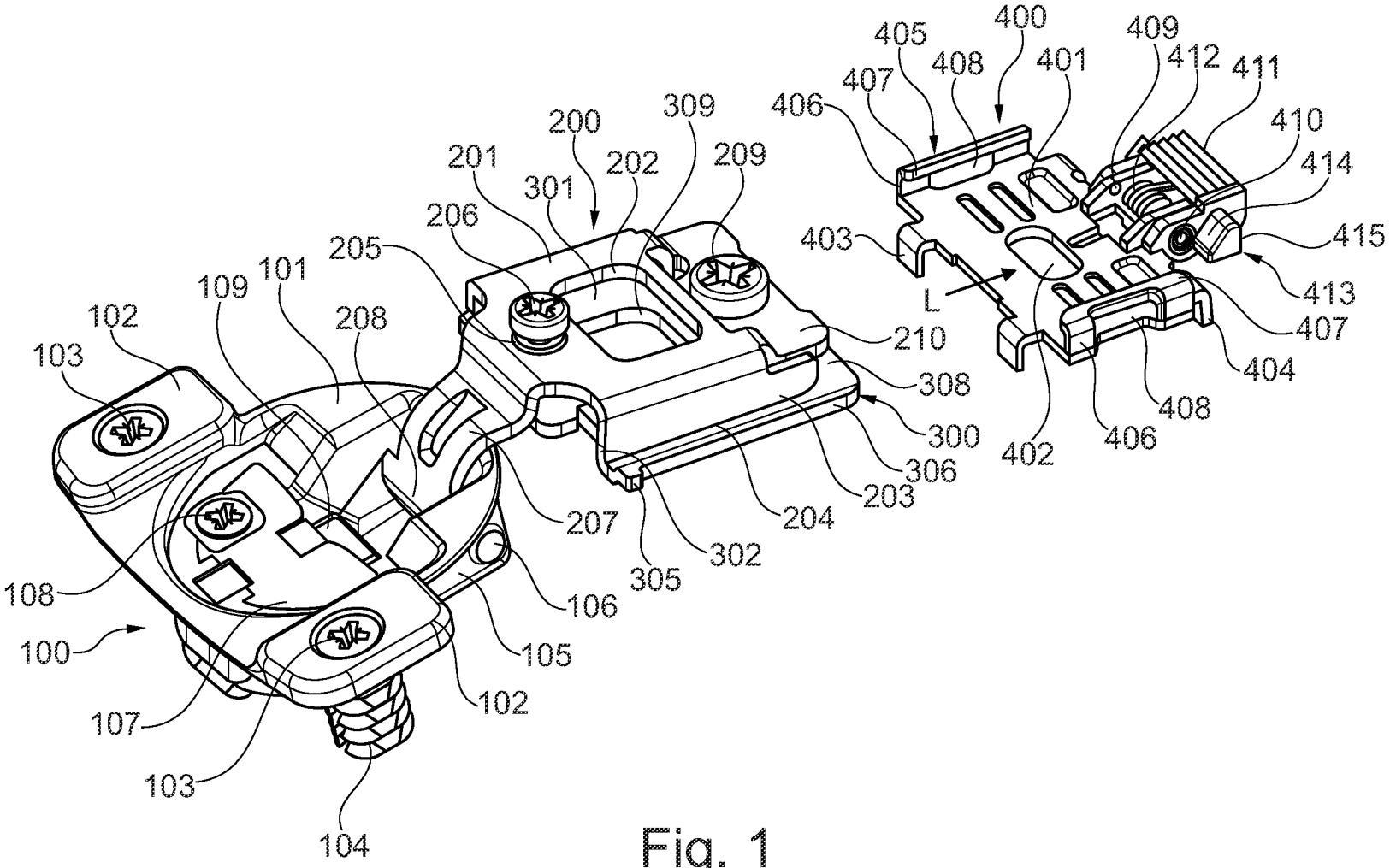

element (300) is aligned in a first mounting direction when adjusted in the guide direction (L).

19 Claims, 5 Drawing Sheets

(51) Int. Cl.
*E05D 5/06* (2006.01)
*E05D 7/10* (2006.01)
*E05F 5/00* (2017.01)
*E05F 5/10* (2006.01)

(52) U.S. Cl.
CPC ..... *E05F 5/10* (2013.01); *E05D 2007/0476* (2013.01); *E05D 2007/0484* (2013.01); *E05D 2007/1094* (2013.01); *E05Y 2900/20* (2013.01)

(58) Field of Classification Search
CPC ..... E05Y 2201/21; E05Y 2201/261; E05Y 2201/11; E05Y 2201/258; E05Y 2201/46; E05Y 2201/474; E05F 5/006; E05F 5/02; E05F 5/027; E05F 5/10; E05D 11/0054; E05D 11/1021; E05D 11/1042; E05D 11/105; E05D 11/1064; E05D 7/04; E05D 7/0407; E05D 7/0423; E05D 7/1083; E05D 7/123; E05D 7/125; E05D 3/142; E05D 5/065; E05D 2207/0476; E05D 2207/0484; E05D 2207/1094; Y10T 16/5383; Y10T 16/304; Y10T 16/54029
See application file for complete search history.

(56) References Cited

U.S. PATENT DOCUMENTS 5,611,112 A * 3/1997 Rock ..... E05D 7/04 16/382
6,148,479 A * 11/2000 Lin ..... E05D 7/125 16/236
6,675,440 B1 * 1/2004 Lautenschlager ..... E05D 7/125 16/258
7,509,708 B1 * 3/2009 Radke ..... E05D 7/081 16/245
8,683,652 B2 * 4/2014 Hagspiel ..... E05D 7/0009 16/236
9,163,447 B1 * 10/2015 Liang ..... E05F 5/006
9,316,035 B2 4/2016 Ng
9,341,010 B2 * 5/2016 Pyo ..... E05D 7/04
9,376,847 B2 6/2016 Salice
9,874,049 B1 * 1/2018 McGregor ..... E05D 5/065
2005/0251963 A1 11/2005 Pozzi
2006/0137139 A1 * 6/2006 Wu ..... E05D 7/0423 16/236
2008/0271292 A1 * 11/2008 Lowe ..... E05D 7/0407 16/238
2013/0145580 A1 * 6/2013 Brunnmayr ..... E05F 5/02 16/84
2014/0359973 A1 * 12/2014 Ng ..... E05D 7/0415 16/225
2015/0337577 A1 * 11/2015 Peer ..... A47B 96/00 16/237
2016/0032636 A1 * 2/2016 Dai ..... E05D 7/0415 16/65
2016/0138319 A1 * 5/2016 Wu ..... E05D 3/02 16/50
2017/0254128 A1 * 9/2017 Ng ..... E05D 3/02
2018/0328093 A1 * 11/2018 Zimmer ..... E05F 5/006

FOREIGN PATENT DOCUMENTS

CN 203394222 U 1/2014
CN 103857863 A 6/2014
CN 104179408 A 12/2014
WO 03069102 A1 8/2003
WO WO-2018033221 A * 2/2018 ..... E05D 7/123

OTHER PUBLICATIONS

International Search Report on corresponding PCT/TR2018/050325, dated Jun. 20, 2019, 11 pages (not prior art).

* cited by examiner

HINGE FOR AN ITEM OF FURNITURE

The invention relates to a hinge for an item of furniture, comprising a first and a second hinge part that are pivotably interconnected by means of a hinged connection, the second hinge part carrying or comprising a mounting element, the mounting element comprising at least one guide assembly comprising a guide that extends in the direction of a longitudinal axis of the mounting element, the mounting element being connected to a retaining part when in the mounting position, and the guide assembly acting between the mounting element and the retaining part, by means of which guide assembly the mounting element can be moved into a mounting position in a manner guided in the guide direction.

Hinges of this kind are known from the prior art. Said hinges are used for example to hingedly attach a door of an item of furniture to a carcass of an item of furniture. The hinges comprise 2 hinge parts that are interconnected by means of a hinged connection. One of the hinge parts is on the carcass of the item of furniture. The other hinge part is coupled to the door of the item of furniture. Cup hinges are often used for coupling, one hinge part being coupled to a hinge cup. Said hinge cup can be inserted into a correspondingly milled out recess in the carcass of the item of furniture or in the door of the item of furniture. Said cup is positioned in a precisely fitting manner therein and can be oriented exactly. For example, what are referred to as container-frame hinges are known, in which the milled recess for the hinge cup is provided in the door. A retaining part can then be mounted on the carcass of the item of furniture. In order to mount the hinge, the second hinge part is joined to the retaining part by means of a mounting element. A releasable latching connection is then usually effective between the mounting element and the retaining part. The joining movement between the mounting element and the retaining part usually takes place via a guide assembly comprising a linear guide that extends in the direction of the longitudinal axis of the hinge. In order to fix a cabinet door to a carcass of an item of furniture, at least 2 hinges are required. Large doors are also often fastened using 3 or more hinges. In order to be able to mount the door, initially all the retaining parts are fixed on the carcass side. The hinges are fastened in the door in the manner described. In order to now be able to mount the door, all the mounting elements are generally aligned to the associated retaining parts. The mounting elements are then pushed into the retaining parts simultaneously. It is the case that manufacturing-related tolerances arise, and therefore the mounting elements cannot be exactly associated with the retaining parts in the specified position. This results at least in significant friction in the linear guides, making mounting of the hinge and dismantling when removing the door more difficult. If the tolerances are too large, jamming results during the joining movement of the door. Laborious reworking is then required, it being necessary for the retaining parts to be released and aligned in a new position.

The object of the invention is therefore that of providing a hinge of the type mentioned at the outset that allows simpler mounting.

This object is achieved in that the guide assembly comprises a first centering guide by means of which the mounting element can be aligned in a first mounting direction when adjusted in the guide direction.

The inventors have found that the linear guides usually used in hinges of this kind are the cause of the problems during mounting. In this respect, said linear guides have been replaced by centering guides, it being possible for the mounting element to be aligned relative to the retaining part, in a mounting direction, when adjusted in the guide direction. In the case of a centering guide, the mounting element is aligned relative to the retaining part during the joining movement. In this case, said alignment movement occurs when mounting element is adjusted in the guide direction, in a mounting direction that extends transversely to the guide direction. In this case, said alignment movement may occur in the centering guide in a continuous or discontinuous manner. The centering guide makes it possible to compensate for manufacture-related tolerances on account of an insertion region of the guide comprising a guide region that is extended relative to the guide region remote from the insertion region. In this respect, during mounting it is possible to first thread the mounting element into the extended guide region of the retaining part, the tolerances being compensated. When joining the mounting element, only a small amount of friction occurs in the centering guide, which is a significant advantage compared with the hinges known from the prior art. In this way, the mounting elements can be mounted more easily and, if necessary, can also be dismantled again using less force.

According to a preferred variant of the invention, it is possible for the guide assembly to comprise a second centering guide by means of which the mounting element can be aligned in a second mounting direction, transverse to the first mounting direction, when adjusted in the guide direction. In the case of a hinge of this kind, the mounting element can be aligned relative to the retaining part in a three-dimensional manner in two planes, which is a further factor that significantly improves and facilitates mounting. It is possible, for example, for the first mounting direction to extend in the direction of the hinge axis and for the second mounting direction to extend transversely to the hinge axis, preferably perpendicularly thereto. In addition, the fundamental explanations described above for the first centering guide also apply with respect to the second centering guide.

The first and/or the second centering guide can be constructed in the simplest manner, in that the first centering guide comprises a first guide surface that extends at an angle to a longitudinal axis of the retaining part that is defined by the guide direction, and/or in that the second centering guide comprises a second guide surface that extends at an angle to the longitudinal axis of the retaining part that is defined by the guide direction. Centering guides of this kind can be easily constructed for example when the mounting element and/or the retaining element are manufactured as stamped bent parts from a sheet metal blank.

A particularly preferred variant of the invention consists in the guide assembly comprising centering elements on opposing sides, each centering element comprising a first guide surface and or a second guide surface in each case, and the first guide surfaces and/or the second guide surfaces being arranged so as to be at an angle to one another. Hinges of this kind can be easily used without problem both for right-handed and for left-handed doors, which constitutes a significant simplification in mounting.

If opposing sides of the guide assembly comprise guide extensions that are substantially U-shaped in cross section and which comprise the centering guides, the guide extensions each surrounding a centering element, in order to form the guide, such that the centering guides rest on or are opposite the guide surfaces in the mounting position, then reliable association of the retaining part to the mounting element is achieved by means of the guide extensions. When the hinge is designed accordingly, this also allows for loads to be carried away reliably via the guide extensions.

A hinge according to the invention may be characterized in that the guide extensions extend in the direction of the guide direction and are chamfered off from a fastening portion. This allows for simple hinge manufacture.

For this purpose, it is also possible for the retaining part to comprise a web-like chamfer that forms the first guide surface and/or the guide surface.

In order to prevent the mounting element from jamming relative to the retaining part when in the mounting position, it is possible for a stop of the mounting element to rest on a counter stop of the retaining part. Therefore, the mounting element can be aligned relative to the retaining part by means of the centering guides during the joining movement. The joining movement is then limited by the stop. As a result, it is also possible to achieve defined positioning of the mounting element relative to the retaining part in the guide direction.

According to a preferred embodiment, the hinge is designed such that the first hinge part comprises a hinge cup that pivotably receives a hinge arm, the hinge arm connecting the first and the second hinge part.

In order to allow for a controlled closing movement, it is possible for the first hinge part to receive a damping means comprising a fluid damper, and for the damping means to preferably be arranged in the hinge cup and for the hinge arm to act thereon when the hinge is being closed, in order to produce a damping effect. It is also conceivable for a closing spring to be provided, which spring preloads the two hinge parts relative to one another and generates a closing force that acts counter to the damping effect. In this respect, a hinge can thus be formed in which a controlled, damped, automatic closing movement can be produced.

If the second hinge part is connected to the mounting element by means of a pivot connection, an adjustment element, in particular an adjustment screw, being provided, by means of which the pivot position between the second hinge part and the mounting element can be adjusted, and if a fastening screw is preferably provided, by means of which the second hinge part can be clamped to the mounting element, then the second hinge part can be aligned relative to the mounting element when in the mounting position. In the aligned position, the second hinge part can be secured by the fastening screw. As a result, the door that is hinged to the carcass of the item of furniture can be positioned in a very precise manner.

If the second hinge part comprises a plate from which extensions bend off on opposing sides, and if the extensions extend across a base part of the mounting element on opposing sides, then the second hinge part can be associated with the mounting element in a correctly positioned and reproducible manner. In addition, a positive connection is created thereby, by means of which the load of the door can be reliably carried away in the direction of the hinge axis when the extensions extend transversely to the hinge axis.

In order to reduce the outlay for parts and mounting, it is possible for the retaining part to comprise a fastening portion through which a screw receptacle for fastening the retaining part to a part of an item of furniture preferably passes, and for the retaining part to comprise at least one bearing piece that forms a bearing, and for a release element comprising a latching element to be pivotably retained on the bearing piece. In this case, it is in particular also possible for the latching element of the release element to comprise a deflection slope that is inclined in the guide direction, for the deflection slope to transition into a latching flank, and for a latching extension of the mounting element to engage behind the latching flank in the mounting position.

Figure 2:
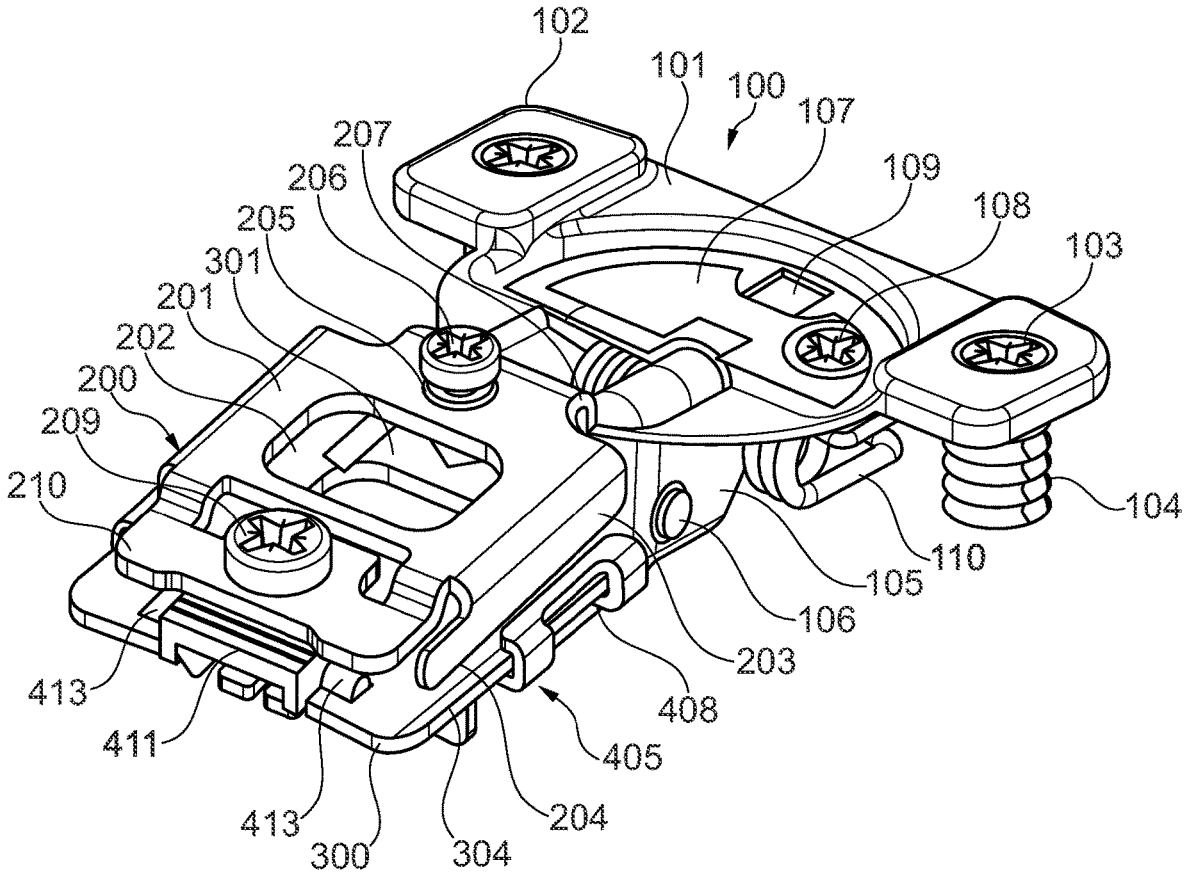
Figure 3:
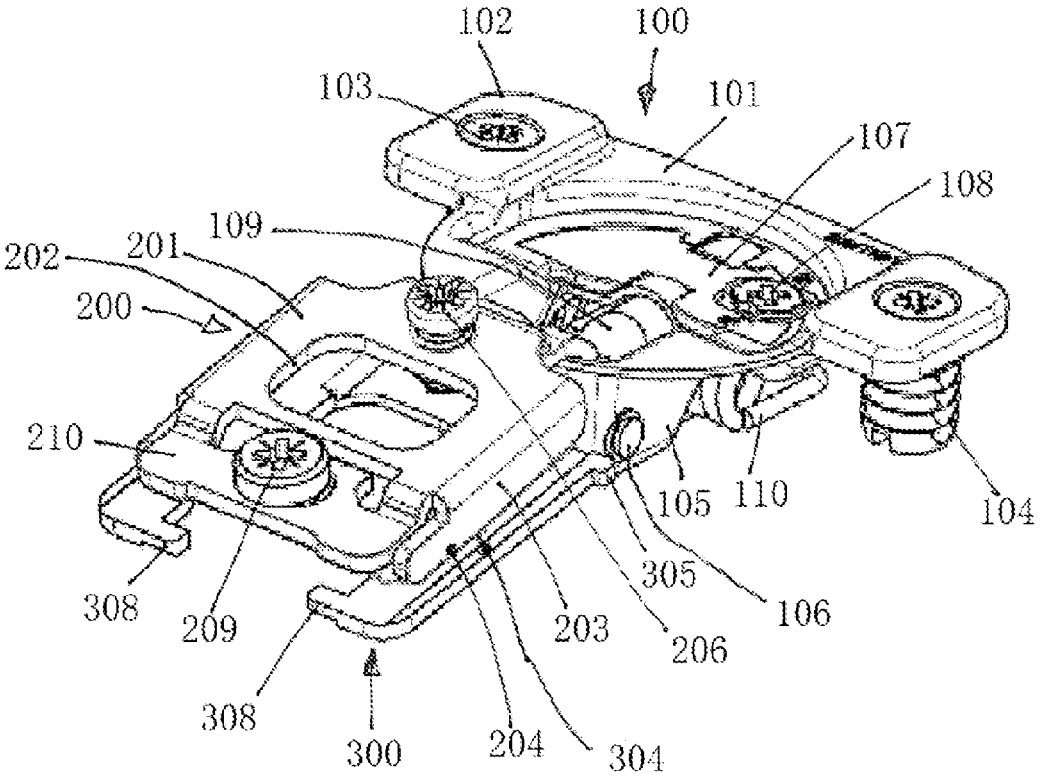
Figure 4:
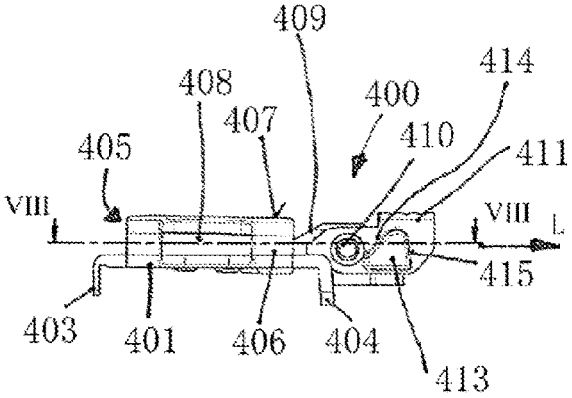
Figure 6:
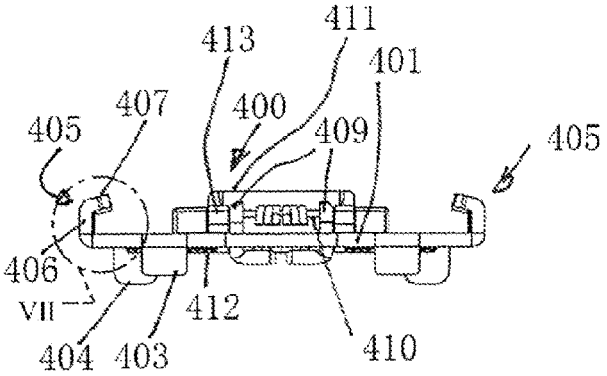
Figure 5:
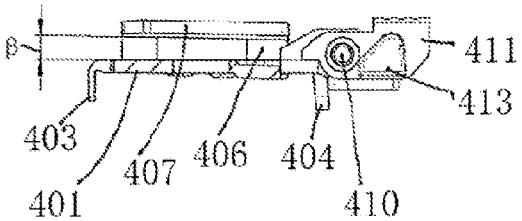
Figure 7:
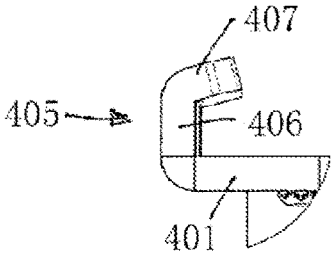
Figure 8:
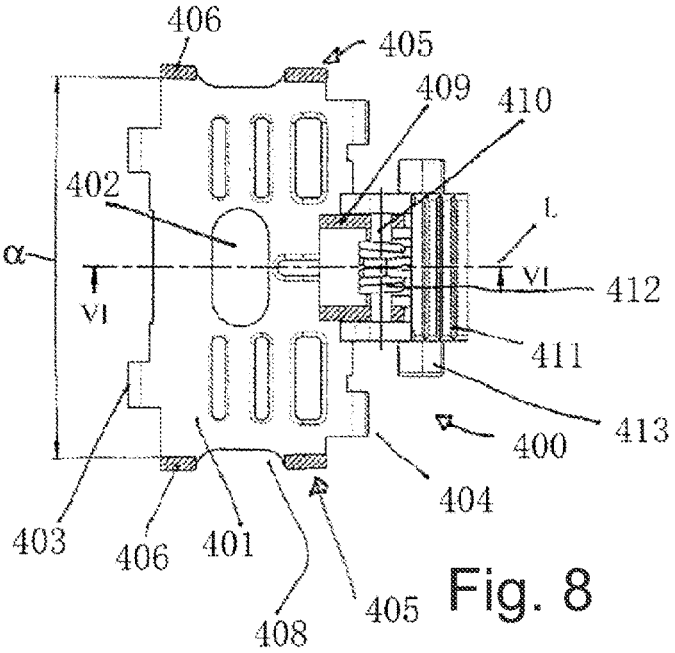
Figure 9:
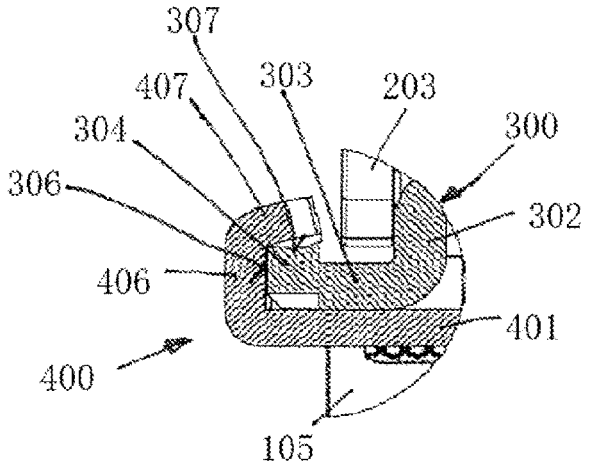
Figure 10:
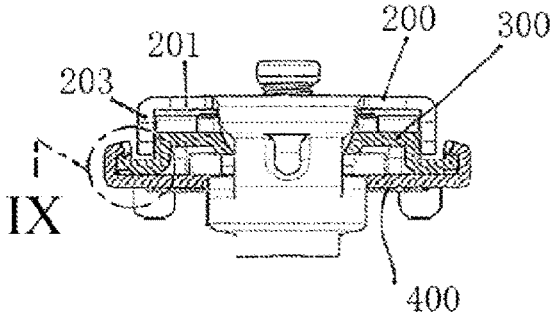
Figure 11:
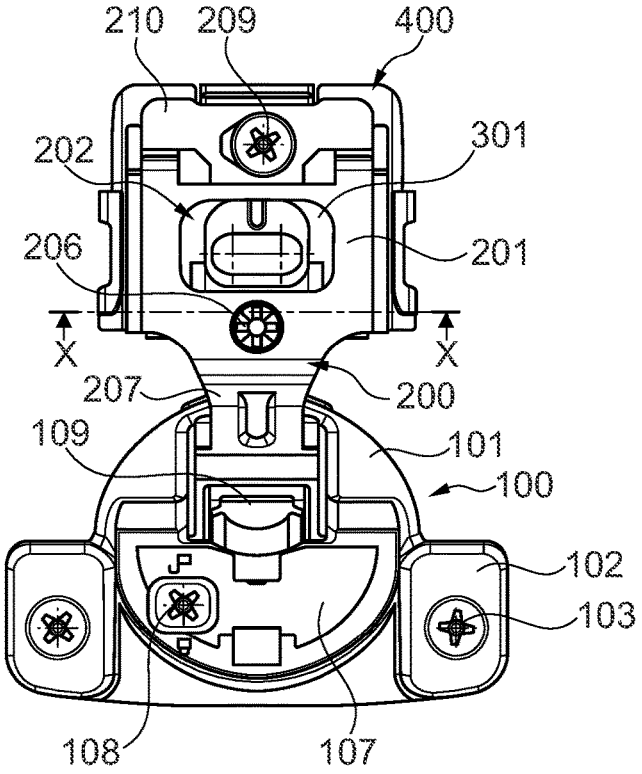

The invention will be explained in greater detail in the following, with reference to an embodiment shown in the drawings. In the drawings:

FIG. 1 is an exploded perspective view of a hinge,

FIG. 2 is a perspective view of the hinge according to FIG. 1 in the mounting position, FIG. 3 is a different perspective view of a module of the hinge shown in FIG. 1, FIG. 4 is a side view of a retaining part of the hinge, FIG. 5 is a front view of the retaining part according to FIG. 4, FIG. 6 shows the retaining part according to FIGS. 4 and 5 along a cutting path marked VI-VI in FIG. 8, FIG. 7 shows a detail marked VII in FIG. 5, FIG. 8 shows the retaining part according to FIGS. 4 to 7 along a cutting path marked VIII-VIII in FIG. 4, FIG. 9 shows a detail marked IX in FIG. 10, FIG. 10 shows the hinge according to FIG. 2 along a cutting path marked X-X in FIG. 11, and FIG. 11 is a plan view of the hinge according to FIG. 1.

FIG. 1 shows a hinge according to the invention, said hinge being what is known as a cup hinge. Of course, the invention can also be applied to other types of hinges and is not limited to cup hinges. The explanations below therefore apply both to cup hinges and to other hinge types.

The hinge comprises two hinge parts 100, 200. These two hinge parts 100, 200 are hingedly interconnected by means of a hinged connection. The first hinge part 100 comprises a hinge cup 105. A limiting element 101 indirectly or directly adjoins the hinge cup 105. Said limiting element 101 may be plate-like and is used to limit the insertion movement of the hinge cup 105 into a milled recess of a part of an item of furniture, the limiting element 101 striking the top of the element of the item of furniture, around the milled recess. The limiting element 101 may for example, as shown in the figure, comprise extensions 102 that extend on opposing sides of the hinge cup 105. The extensions 102 comprise receptacles. The fastening elements 103 are pushed through the receptacles. The fastening elements may be formed by fastening screws. In this case, the fastening screws can be screwed into anchors 104 in a pre-mounting position, as shown in the figure.

A damping device 109 is received in the hinge cup 105. In this case, the damping device 109 may comprise a fluid damper. This fluid damper may for example be an air damper or a liquid damper. The fluid damper may be formed as a linear damper for example, said damper comprising a damping cylinder in which a piston is linearly adjustable. A piston rod may be coupled to the piston. The damping device 109 can be covered by a cover 107 in order to be fixed securely in the hinge cup 105 for example, the cover 107 being connected to the first hinge part 100.

According to a preferred variant, it is furthermore also possible to use a switching means. The damping effect of the damping device 109 can be adjusted or at least in part prevented thereby. It is conceivable, for example, for the switching means to block the damping means 109 in the compressed or partially compressed state thereof, i.e. when the piston has been inserted completely or in part into the cylinder. In this state, no or just a short damping path is provided. The switching means may comprise an actuator 108. As shown in FIG. 1, the actuator 108 is user-friendly and is easily accessible from the front of the hinge cup 105.

The two hinge parts 100, 200 are interconnected by means of a hinge arm 207. The hinge arm 207 is integrally attached to the second hinge part 200 in order to reduce the outlay for parts. It is also conceivable, however, for the hinge arm 207 to be attached to the first hinge part 100 or to be a separate component. In the present embodiment, the hinge arm 207 is fastened to the hinge cup 105 by means of a hinge pin 106. The hinge arm 207 comprises a gudgeon 208 that is integrally molded on and through which the hinge pin 106 is guided. The pivot axis is thus arranged in the region of the hinge cup 105. The hinge arm 207 is designed and arranged so as to also be used for operating the damping means 109. In this respect, a convexly curved contour (visible in FIG. 1) of the hinge arm 207 strikes an actuation element of the damping device 109 (see reference sign 109 in FIG. 1) during the closing movement of the hinge proceeding from the open position shown in FIG. 1. In this case, the damping cylinder and the piston that is guided therein are adjusted relative to one another.

The second hinge part 200 comprises a plate 201. The hinge arm 207 is integrally molded onto said plate 201. A recess 202 passes through the plate 201. Extensions 203 bend off on opposing sides of the plate 201. The ends of the extensions 203 that are turned away from the bend region comprise an end portion 204 having a curved contour.

A thread receptacle 205 may be provided in the plate 201. An adjustment element 206, preferably in the form of an adjustment screw, is inserted into said thread receptacle 205.

As can furthermore be seen in FIG. 1, the second hinge part comprises a support portion 210 that is molded on. Said support portion 210 comprises a screw receptacle. A fastening screw 209 can be pushed through said screw receptacle.

A mounting element 300 can be connected to the second hinge part 200. The structure of the mounting element 300 can be seen in greater detail in FIGS. 9 to 11. As these drawings show, the mounting element 300 comprises a base part 301. Chamfers 302 are provided on the two opposing sides of the base part 301. The two extensions 203 of the second hinge part in each case rest on the outside of said chamfers 302, as shown in FIG. 10. The chamfers 302 thus form a positive contact means for the extensions 203 in the direction of the hinge axis. Transition portions 303 adjoin the chamfers 302. Said transition portions 303 are bent off from the chamfers 302 and are preferably aligned so as to be at right-angles thereto. The transition portions 303 each carry a centering element 304. Centering elements 304 are thus provided on both sides of the mounting element 300. The centering elements 304 comprise at least one guide surface 306, 307. In the preferred embodiment shown in the drawings, two guide surfaces 306, 307 are provided per centering element 304.

As can be seen in FIG. 1, the mounting element 300 extends in the direction of the longitudinal axis L of the hinge, the longitudinal axis L also simultaneously defining the joining direction of the mounting element 300 into the retaining part 400. The mounting element 300 is preferably symmetrical with respect to the longitudinal axis L. The first guide surface 306 mentioned above extends so as to be inclined and at the angle of the longitudinal axis L, the guide surface 306 extending so as to be inclined inwardly proceeding from an end facing the first hinge part 100 in FIG. 1, i.e. so as to be inclined towards the component center of the mounting element 300. The two guide surfaces 306 of the centering element 304 thus extend so as to be inclined at an acute angle relative to one another. An angle between the guide surfaces 306 can preferably be in the range between 1 and 10°.

The second guide surfaces 307 that are provided in addition and/or alternatively extend proceeding from the end facing the first hinge part 100 in FIG. 1 towards the end remote from the first hinge part 100 in a sloping, and thus inclined, manner. In this case, the inclination angle can preferably be in the range between 0.5 and 5°.

As can further be seen in FIG. 1, stops 305 are also molded on the mounting element 300, on opposing sides. It is also conceivable to use just one stop 305.

According to FIG. 3, two latching extensions 308 are provided on the region of the mounting element 300 remote from the first hinge part 100. The function of said latching extensions 308 will be explained later.

As can be seen in FIG. 1, the retaining part 400 is used. The design of the retaining part 400 can be seen more clearly in FIGS. 4 to 8. As these drawings show, the retaining part 400 comprises a fastening portion 401. The fastening portion 401 is plate-like. Said portion comprises an opening in the form of a screw receptacle 402. Guides 405 are provided on sides of the retaining part 400 that are opposing with respect to the longitudinal axis L. In this case, the guides 405 each form a first centering guide 406. In addition and/or alternatively, a second centering guide 407 may also be provided. The centering guides 406, 407 are designed so as to be complementary to the guide surfaces 306, 307. Accordingly, the centering guide 406 extends so as to be at an angle and inclined inwardly proceeding from the insertion region of the retaining part 400 facing the first hinge part 100, towards the end of the retaining part 400 remote from the insertion region. In this respect, the two centering guides 406, which may be planar according to the present embodiment, are at an acute angle relative to one another, the angle preferably being selected in accordance with the pitch of the guide surfaces 306, 307. The pitch of the centering guides 406 results in a guide receptacle for the mounting element 306 that tapers in the direction of the longitudinal axis L.

The centering guides 407 can be designed so as to be complementary to the guide surfaces 307 of the mounting element 300. Said guides accordingly extend so as to be inclined, proceeding form the insertion region. Accordingly, a tapering receptacle is provided in the direction of the longitudinal axis L, proceeding form the insertion region between the fastening portion 401 and the regions of the second centering guides 407 associated in each case. The inclined pitch of the centering guides 406 and 407 can be seen in FIG. 5 and in the enlarged view in FIG. 7. In FIG. 8, the pitch angle $\alpha$ shows the inclined pitch of the first centering guides 406 relative to the longitudinal axis L and to one another. In FIG. 6, the pitch angle $\beta$ shows the inclined pitch of the second centering guide 407 relative to the top of the fastening portion 401.

As can be seen in the drawing according to FIG. 8, one or two bearing pieces 409 are molded onto the fastening portion 401. Said bearing pieces are preferably chamfered off from the fastening portion 401. The bearing pieces 409 comprise a bearing receptacle. The bearing receptacle is in alignment with a bearing receptacle of a release element 411. The release element 411 is pivotably connected to the retaining element 400 by means of a bearing 410, preferably a bearing pin, that is guided through the mutually aligned bearing receptacles.

In the preload state shown in FIG. 1, the release element 411 is aligned relative to the retaining part 400 by means of a spring 412. The release element 411 comprises a hand-operated actuation surface (see the corrugated upwardly facing surface in FIG. 1). On this actuating surface, the release element 411 can be pivoted into the bearing 410 counter to the preload of the spring 412. The release element 411 comprises one, preferably two, latching elements 413. As shown in FIG. 1, said latching elements 413 are provided on both sides of the release element 411.

The latching element 413 comprises a deflection slope 414 that extends so as to be inclined in the direction of the longitudinal axis. The deflection slope 414 transitions into a steep latching flank 415 in the opposing direction to the longitudinal axis L.

In order to mount the hinge shown in the drawings, the retaining part 400 is initially attached to a carcass of an item of furniture. Alignment elements 403, 404 protrude on the underside of the retaining part 400. The retaining part 400 can be aligned to associated surfaces, for example to a frame profile of the part of the item of furniture, by means of said alignment elements 403, 404. In order to fasten the retaining part 400 on the part of the item of furniture, a fastening screw is guided through the screw receptacle 402 of the retaining part 400 and screwed into a thread receptacle of the carcass of the item of furniture. The pre-mounted module shown in FIG. 1 can now be mounted on the retaining part 400 that is fixed in this way. For this purpose, the free end of the mounting element 300 is pushed into the guides 405. This is achieved in a simple manner, since the first centering guides 406 align the mounting element 300 in a first mounting direction that extends in the direction of or substantially in the direction of the hinge axis (axis of the hinge pin 106). In this case, the first guide surfaces 306 are guided and aligned on the first centering guides 406. At the same time, alignment of the mounting element 300 in a second mounting direction that extends transversely to the first mounting direction is brought about in the event of the mounting movement in the direction of the longitudinal axis L. In this case, the second guide surfaces 307 of the centering elements 304 are accordingly aligned to the second centering guides 407 of the guides 405, in a plane extending transversely to the hinge axis. The association brought about thereby between the guide surfaces 306, 307 and the centering guides 406, 407 can be seen in particular in FIGS. 9 and 10, which show the hinge in the mounting position.

During the joining process, the latching extensions 308 glide on the deflection slopes 414 of the release element 411. As a result, the release element 411 is pivoted about the pivot axis of the bearing 410. As soon as the latching extensions 308 have passed the deflection slopes 414, the release element 411 snaps back into the upright position thereof shown in FIG. 1, the latching extensions 308 engaging behind the latching flanks 415. This brings about the firm association between the mounting element 300 and the retaining part 400. At the same time, the joining movement is also limited by the stops 305. Said stops 305 strike the retaining part 400. According to the present embodiment, the stops 305 strike the end of the first centering guides 406 at the end of the end of the guides 405 facing the insertion region. Of course, a stop connection to a stop 305 for limiting the joining movement relative to the retaining part 400 may also be provided at any other point. Limiting the joining movement by means of a stop 305 prevents the guide surfaces 306, 307 of the mounting element 300 from clamping onto the associated centering guides 406 and/or 407 in a wedge-shaped manner, which would impede dismantling in particular if the pitch angles of the guide surfaces 306, 307 or of the centering guides 406, 407 were selected to be so small that self-locking would occur in the wedge connection.

The second hinge part 200 is screwed to the mounting element 300 by means of the fastening screw 209. For this purpose, the fastening screw 209 is inserted through a screw receptacle in the support portion 210 and screwed into a thread receptacle of the mounting element 300. Consequently, the module on the left in FIG. 1 is thus associated with and fastened to the retaining element 400 in a precisely positioned and aligned manner.

It may be the case that it is necessary to adjust the hinge in order to align a door that is fastened to the hinge. The alignment can be carried out in two planes, using the hinge shown in the drawings. Alignment in the direction of the hinge axis can be carried out by releasing the screw that is inserted through the screw receptacle 402 of the retaining part 400. This is easily possible on account of the mutually aligned recesses 202, 309 in the second hinge part 200 and in the mounting element 300, respectively. A screwdriver can access the screw head of the fastening screw through said recesses 202, 309. When the fastening screw is released, the retaining part 400 can be adjusted in a limited manner in the direction of the hinge axis, since the cross section of the screw shank is smaller than the extent of the screw receptacle 402 in the direction of the hinge axis. Alignment of the hinge perpendicularly to the hinge axis can be carried out by means of the adjustment element 206. For this purpose, the fastening screw 209 is first released. The adjustment element 206, designed as an adjustment screw, can then pivot the second hinge part arm 200 relative to the mounting element 300. This is possible because the end of adjustment screw remote from the screw head is supported on a support region of the base part 301 of the mounting element 300 and said adjustment screw is simultaneously screwed into a thread receptacle 205 of the hinge arm 207. As soon as the desired adjustment position is reached, the fastening screw 209 can be tightened again. During adjustment by means of the adjustment screw, the pivoting of the hinge arm 207 relative to the mounting element 300 occurs about an axis that is located substantially in the region of the support portion 210. In order to prevent a collision with the mounting element 300, the end portions 204 of the extensions 203 have the curved contour mentioned above. This makes it possible to achieve a small overall height.

In order to dismantle the door, it is merely necessary for the release element 411 to be actuated by hand and pivoted about the pivot axis of the bearing 410. In the process, the latching extensions 308 are then disengaged from the latching flanks 415 of the release element 411. Subsequently, the mounting element 300 can be removed from the guides 405 of the retaining part 400. This is achieved simply and without using much force, on account of the use according to the invention of centering guides 406, 407. In particular, no high friction forces need to be overcome here.

Within the meaning of the invention, the hinge described above thus comprises two interconnected hinge parts 100, 200, the second hinge part 200 carrying or comprising a mounting element 300. The mounting element 300 comprises at least one guide assembly comprising at least one guide 405 that extends in the direction of a longitudinal axis L of the mounting element 300. In the mounting position, the mounting element 300 is connected to a retaining part 400 and the guide assembly acts between the mounting element 300 and the retaining part 400, by means of which guide assembly the mounting element 300 can be moved into a mounting position in a manner guided in the guide direction. The guide assembly comprises at least one first centering guide 406, by means of which the mounting element 300 is aligned in a first mounting direction when adjusted in the guide direction L.

The invention claimed is:

1. A hinge for an item of furniture, the hinge comprising:

a first hinge part;

a second hinge part, wherein the second hinge part carries or includes a mounting element, the mounting element having a longitudinal axis;

a hinged connection pivotably interconnecting the first and second hinge parts;

a retaining part configured to be connected to the mounting element when the mounting element is in a mounting position on the retaining part; and a guide assembly configured to act between the mounting element and the retaining part, the guide assembly including a first centering guide configured such that the mounting element is guided in a first mounting direction when the mounting element is moved in a guide direction parallel to the longitudinal axis of the mounting element to move the mounting element into the mounting position on the retaining part;

wherein the first hinge part includes a hinge cup; and wherein the hinged connection includes a hinge arm pivotably received in the hinge cup, the hinge arm connecting the first and second hinge parts.

2. The hinge of claim 1, wherein:

the guide assembly includes a second centering guide configured such that the mounting element is guided in a second mounting direction transverse to the first mounting direction when the mounting element is moved in the guide direction of the longitudinal axis of the mounting element to move the mounting element into the mounting position on the retaining part.

3. The hinge of claim 2, wherein:

the guide assembly includes a first guide surface defined on the mounting element and extending at an angle to the longitudinal axis of the mounting element, the first guide surface configured to engage the first centering guide.

4. The hinge of claim 3, wherein:

the guide assembly includes a second guide surface defined on the mounting element and extending at an angle to the longitudinal axis of the mounting element, the second guide surface configured to engage the second centering guide.

5. The hinge of claim 4, wherein:

the guide assembly includes opposing guides defined on the retaining part, each of the opposing guides including one each of both the first and second centering guides; and the guide assembly includes centering elements on opposing sides of the mounting element, each centering element including one each of both the first and second guide surfaces, the centering elements on opposing sides of the mounting element being configured to be received in the opposing guides of the retaining part.

6. The hinge of claim 5, wherein:

the opposing guides defined on the retaining part include guide extensions substantially U-shaped in cross-section, the guide extensions each partially surrounding one of the centering elements of the mounting element.

7. The hinge of claim 6, wherein:

the opposing guides defined on the retaining part extend in the guide direction and are integrally formed with a fastening portion of the retaining part by bending of a sheet metal blank.

8. The hinge of claim 2, wherein:

the hinged connection includes a hinge axis; and the first mounting direction extends parallel to the hinge axis.

9. The hinge of claim 8, wherein:

the second mounting direction extends perpendicularly to the hinge axis.

10. The hinge of claim 2, wherein:

the guide assembly includes centering elements on opposing sides of the mounting element, each centering element including a first guide surface configured to guide the mounting element in the first mounting direction, the first guide surfaces being configured to be at an angle to one another.

11. The hinge of claim 10, wherein:

the angle between the first guide surfaces is in a range from about 1° to about 10°.

12. The hinge of claim 10, wherein:

each centering element further includes a second guide surface, the second guide surfaces being inclined downwardly at an inclination angle in a direction away from the first hinge part.

13. The hinge of claim 12, wherein:

the inclination angle of the second guide surfaces is in a range of about 0.5° to about 5°.

14. The hinge of claim 1, wherein:

the mounting element includes a stop;

the retaining part includes a counter stop; and wherein the stop rests on the counter stop when the mounting element is in the mounting position on the retaining part.

15. The hinge of claim 1, wherein:

the first hinge part includes a fluid damper received in the hinge cup; and the hinge arm is configured to act on the fluid damper so as to produce a damping effect when the hinged connection is being closed.

16. The hinge of claim 1, wherein:

the mounting element includes a base part; and the second hinge part includes a plate from which extensions bend off on opposing sides of the plate, the extensions extending across the base part of the mounting element on opposing sides of the base part.

17. The hinge of claim 1, wherein:

the retaining part includes a fastening portion including a screw receptacle for receiving a screw to fasten the retaining part to the item of furniture;

the retaining part includes at least one bearing piece forming a bearing; and the hinge further includes a release element including a latching element pivotably retained on the bearing piece.

18. The hinge of claim 17, wherein:

the latching element includes a deflection slope inclined in the guide direction, the deflection slope transitioning into a latching flank of the latching element; and the mounting element includes a latching extension configured to engage behind the latching flank when the mounting element is in the mounting position on the retaining part.

19. A hinge for an item of furniture, the hinge comprising:

a first hinge part;

a second hinge part, wherein the second hinge part carries or includes a mounting element, the mounting element having a longitudinal axis;

a hinged connection pivotably interconnecting the first and second hinge parts;

a retaining part configured to be connected to the mounting element when the mounting element is in a mounting position on the retaining part; and a guide assembly configured to act between the mounting element and the retaining part, the guide assembly including a first centering guide configured such that the mounting element is guided in a first mounting direction when the mounting element is moved in a guide direction parallel to the longitudinal axis of the mounting element to move the mounting element into the mounting position on the retaining part;

wherein the second hinge part is connected to the mounting element by a pivot connection; and wherein the hinge further includes:

an adjustment screw configured such that the pivot connection of the second hinge part to the mounting element is adjustable by the adjustment screw; and a fastening screw configured to clamp the second hinge part to the mounting element.

* * * * *